US009611753B2

(12) United States Patent
Salm et al.

(10) Patent No.: US 9,611,753 B2
(45) Date of Patent: Apr. 4, 2017

(54) APPARATUS AND METHOD FOR INSPECTING A TURBINE BLADE TIP SHROUD

(71) Applicant: General Electric Company, Schenectady, NY (US)

(72) Inventors: Jacob Andrew Salm, Simpsonville, SC (US); Blake Allen Fulton, Simpsonville, SC (US); Keith Alan Lord, Greenville, SC (US)

(73) Assignee: General Electric Company, Schenectady, NY (US)

( * ) Notice: Subject to any disclaimer, the term of this patent is extended or adjusted under 35 U.S.C. 154(b) by 295 days.

(21) Appl. No.: 14/264,202

(22) Filed: Apr. 29, 2014

(65) Prior Publication Data

US 2015/0308284 A1 Oct. 29, 2015

(51) Int. Cl.

| | |
|---|---|
| ***G01N 19/00*** | (2006.01) |
| ***F01D 21/00*** | (2006.01) |
| ***F01D 25/28*** | (2006.01) |
| ***F01D 5/00*** | (2006.01) |
| ***F01D 25/00*** | (2006.01) |

(52) U.S. Cl.

CPC ..... *F01D 21/003* (2013.01); *F01D 5/005* (2013.01); *F01D 25/00* (2013.01); *F01D 25/285* (2013.01); *F05D 2260/80* (2013.01)

(58) Field of Classification Search

CPC ..... F01D 5/005; F01D 21/003; F01D 25/285; F01D 5/225

USPC ... 73/865.8, 112.01, 112.03, 116.03, 116.04, 73/861.92; 416/179–191

See application file for complete search history.

(56) References Cited

U.S. PATENT DOCUMENTS

| | | | | |
|---|---|---|---|---|
| 2,977,533 | A | 3/1961 | Savage | |
| 4,291,448 | A | 9/1981 | Cretella et al. | |
| 4,333,239 | A * | 6/1982 | Arrigoni | G01B 5/205 33/535 |
| 5,133,643 | A | 7/1992 | Ortolano | |
| 5,162,659 | A | 11/1992 | Diamond et al. | |
| 6,164,916 | A | 12/2000 | Frost et al. | |
| 6,701,616 | B2 | 3/2004 | Smith et al. | |
| 6,792,655 | B2 | 9/2004 | Wah | |
| 6,842,995 | B2 | 1/2005 | Jones et al. | |

(Continued)

FOREIGN PATENT DOCUMENTS

WO 2008094972 A2 8/2008

*Primary Examiner* — Harshad R Patel
*Assistant Examiner* — Roger Hernandez-Prewit
(74) *Attorney, Agent, or Firm* — Ernst G. Cusick; Frank A. Landgraff

(57) ABSTRACT

An apparatus for inspecting a turbine blade tip shroud includes a frame comprising a top surface and a bottom surface that is alignable with the turbine blade tip shroud, and, at least one z-notch inspection slot that passes through the frame from the top surface to the bottom surface and is positioned to align with at least one z-notch of the turbine blade tip shroud when the frame is aligned on the turbine blade tip shroud. The apparatus further includes a removable z-notch inspection insert comprising a cross-sectional profile substantially matching the at least one z-notch inspection slot and comprising a z-notch guide face that faces the z-notch of the turbine blade tip shroud when the removable z-notch inspection insert is passed through the z-notch inspection slot

13 Claims, 6 Drawing Sheets

(56) References Cited

U.S. PATENT DOCUMENTS

| | | | | |
|---|---|---|---|---|
| 6,906,808 | B2 | 6/2005 | Trantow et al. | |
| 6,910,278 | B2 | 6/2005 | Holder | |
| 7,024,787 | B2 | 4/2006 | Varsell et al. | |
| 7,328,496 | B2 | 2/2008 | Powers et al. | |
| 7,337,520 | B2 | 3/2008 | Jones et al. | |
| 8,037,768 | B2 | 10/2011 | Ichiryu | |
| 8,043,061 | B2 | 10/2011 | Chiurato et al. | |
| 2007/0079507 | A1 | 4/2007 | Cheng et al. | |
| 2009/0064520 | A1* | 3/2009 | Sherlock | F01D 25/285 33/562 |
| 2009/0123268 | A1 | 5/2009 | Brittingham et al. | |
| 2014/0003948 | A1 | 1/2014 | Dubs et al. | |

* cited by examiner

APPARATUS AND METHOD FOR INSPECTING A TURBINE BLADE TIP SHROUD

FIELD OF THE INVENTION

The present invention generally involves an apparatus and method for inspecting a turbine blade tip shroud. In particular embodiments, the apparatus may facilitate a quality inspection check for turbine blade tip shroud z-notches.

BACKGROUND OF THE INVENTION

Turbines are widely used in industrial and commercial operations. A typical commercial steam or gas turbine used to generate electrical power includes alternating stages of stationary vanes and rotating blades. The stationary vanes may be attached to a stationary component such as a casing that surrounds the turbine, and the rotating blades may be attached to a rotor located along an axial centerline of the turbine. A compressed working fluid, such as but not limited to steam, combustion gases, or air, flows through the turbine, and the stationary vanes accelerate and direct the compressed working fluid onto the subsequent stage of rotating blades to impart motion to the rotating blades, thus turning the rotor and performing work.

Compressed working fluid that leaks around or bypasses the stationary vanes or rotating blades reduces the efficiency of the turbine. To reduce the amount of compressed working fluid that bypasses the rotating blades, the casing may include stationary shroud segments that surround each stage of rotating blades, and each rotating blade may include a tip shroud at an outer radial tip. Each tip shroud may include a seal rail that extends transversely across the tip shroud to form a seal between the rotating tip shroud and the stationary shroud segments. In addition, each tip shroud may include side surfaces that interlock with complementary side surfaces of adjacent tip shrouds to prevent adjacent tip shrouds from overlapping, reduce vibrations in the rotating blades, and enhance the seal between the rotating tip shrouds and the stationary shroud segments.

Over time, the side surfaces of the tip shrouds may erode or wear, creating gaps between adjacent tip shrouds that allow the rotating blades to twist and/or vibrate and increase the amount of compressed working fluid that bypasses the rotating blades. As a result, hardened materials are typically plated onto the side surfaces and periodically inspected to determine the amount of wear to the hardened materials. If the amount of wear is excessive, the entire rotating blade may need to be replaced. Otherwise, the tip shroud may be refurbished to restore and/or increase the thickness of the hardened materials on the side surfaces.

Previous efforts have been developed to determine the amount of erosion of the hardened materials. For example, measurements of various chord lengths across the tip shroud may be used to create a detailed coordinate map of the surface of the tip shroud. However, coordinate mapping is time-consuming and produces inconsistent results due to the geometric shape of the tip shroud. As a result, an alternative apparatus and method for inspecting a turbine blade tip shroud would be welcomed in the art.

BRIEF DESCRIPTION OF THE INVENTION

Aspects and advantages of the invention are set forth below in the following description, or may be obvious from the description, or may be learned through practice of the invention.

In one embodiment an apparatus for inspecting a turbine blade tip shroud is disclosed. The apparatus includes a frame comprising a top surface and a bottom surface that is alignable with the turbine blade tip shroud, and, at least one z-notch inspection slot that passes through the frame from the top surface to the bottom surface and is positioned to align with at least one z-notch of the turbine blade tip shroud when the frame is aligned on the turbine blade tip shroud. The apparatus further includes a removable z-notch inspection insert comprising a cross-sectional profile substantially matching the at least one z-notch inspection slot and comprising a z-notch guide face that faces the z-notch of the turbine blade tip shroud when the removable z-notch inspection insert is passed through the z-notch inspection slot.

In another embodiment, another apparatus for inspecting a turbine blade tip shroud is disclosed. The apparatus includes a frame comprising a top surface and a bottom surface that is alignable with the turbine blade tip shroud, a first z-notch inspection slot that passes through the frame from the top surface to the bottom surface and is positioned to align with a first z-notch of the turbine blade tip shroud when the frame is aligned on the turbine blade tip shroud, and, a first removable z-notch inspection insert comprising a first cross-sectional profile substantially matching the first z-notch inspection slot and comprising a first z-notch guide face that faces the first z-notch of the turbine blade tip shroud when the first removable z-notch inspection insert is passed through the first z-notch inspection slot. The apparatus further includes a second z-notch inspection slot that passes through the frame from the top surface to the bottom surface and is positioned to align with a second z-notch of the turbine blade tip shroud when the frame is aligned on the turbine blade tip shroud, and, a second removable z-notch inspection insert comprising a second cross-sectional profile substantially matching the second z-notch inspection slot and comprising a second z-notch guide face that faces the second z-notch of the turbine blade tip shroud when the second removable z-notch inspection insert is passed through the second z-notch inspection slot.

In yet another embodiment, a method for inspecting a turbine blade tip shroud is disclosed. The method includes aligning a frame on the turbine blade tip shroud, wherein the frame comprises at least one z-notch inspection slot that passes through the top surface to the bottom surface and is positioned to align with at least one z-notch of the turbine blade tip shroud while the frame is aligned on the turbine blade tip shroud, and passing a removable z-notch inspection insert through the z-notch inspection slot, wherein a z-notch guide face of the z-notch inspection insert will pass by the at least one z-notch of the turbine blade tip shroud if the z-notch does not extend beyond the z-notch inspection slot.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
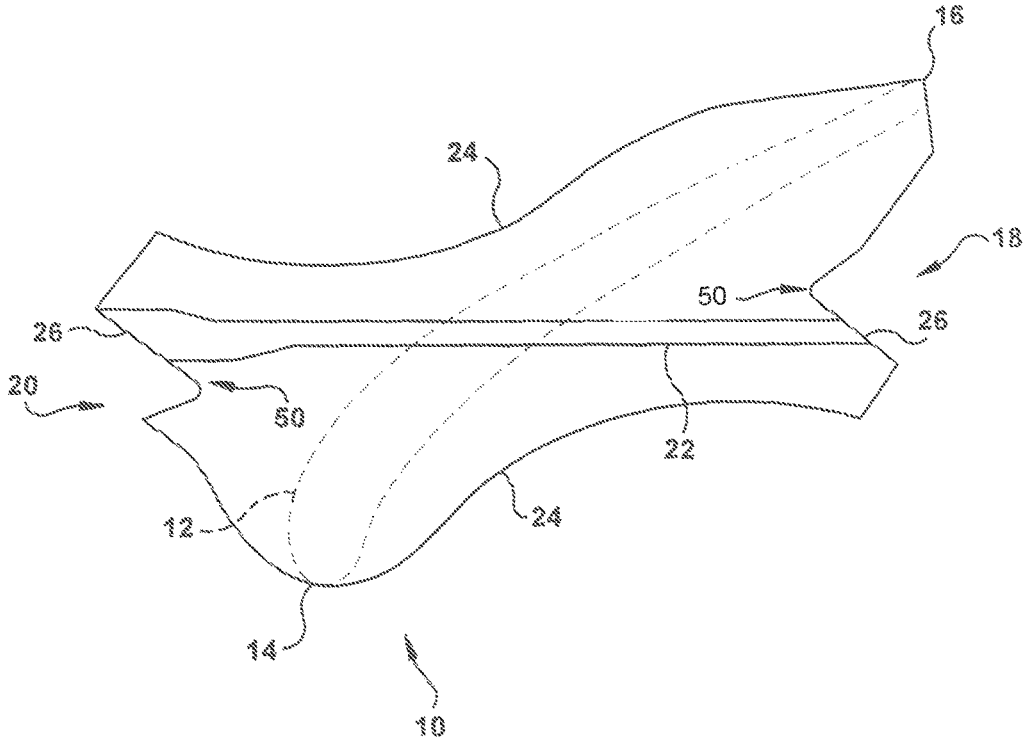
FIG. 1 is a top plan view of an exemplary turbine blade tip shroud.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. In addition, the terms "upstream" and "downstream" refer to the relative location of components in a fluid pathway. For example, component A is upstream from component B if a fluid flows from component A to component B. Conversely, component B is downstream from component A if component B receives a fluid flow from component A.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present disclosure include an apparatus and method for inspecting a turbine blade tip shroud. The apparatus generally includes a frame that can be placed over the tip shroud to identify an acceptable or non-acceptable dimension of one or both of the z-notches.

FIG. 1 provides a top plan view of an exemplary turbine blade tip shroud 10. The tip shroud 10 is located at a radial tip of a rotating blade 12, with the outline of the rotating blade 12 beneath the tip shroud 10 shown in phantom in FIG. 1. The tip shroud 10 generally includes a leading edge 14 and a trailing edge 16 that correspond to the direction of airflow over the rotating blade 12. In addition, the tip shroud 10 includes a first side surface 18 generally opposed to a second side surface 20, with a seal rail 22 extending across the tip shroud 10 from the first side surface 18 to the second side surface 20. The first and second side surfaces 18, 20 may additionally include scalloped surfaces 24 and hardened surfaces 26 designed to interlock with side surfaces of adjacent tip shrouds. For example, in the exemplary tip shroud 10 shown in FIG. 1, the hardened surfaces 26 appear as z-notches 50 in the first and second side surfaces 18, 20.

As should be appreciated to those skilled in the art, the z-notch 50 refers to a z-shaped profile design that reduces or substantially reduces stress in the tip shroud 10. Specifically, the z-notch 50 can help address cracks attributable to low cycle and/or high cycle fatigue. In some embodiments, the z-notch 50 may be present on a new tip shroud 10 from original manufacturing prior to the tip shroud 10 seeing service. In other embodiments, the z-notch 50 may be present after adjusting its dimensional profile through weld build-up, blending and/or contouring from any modification operations (e.g., repair, restoration or the like).

Figure 2:
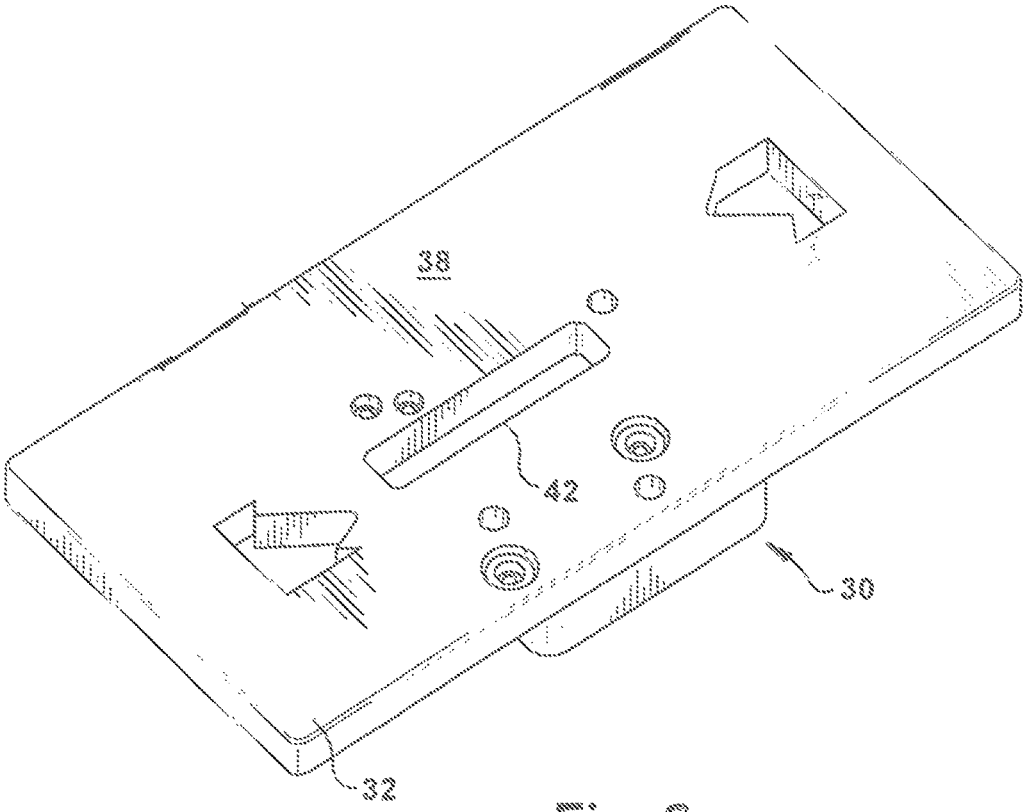
FIG. 2 is a top perspective view of an apparatus for inspecting a turbine blade tip shroud according to one embodiment of the present invention.
Figure 3:
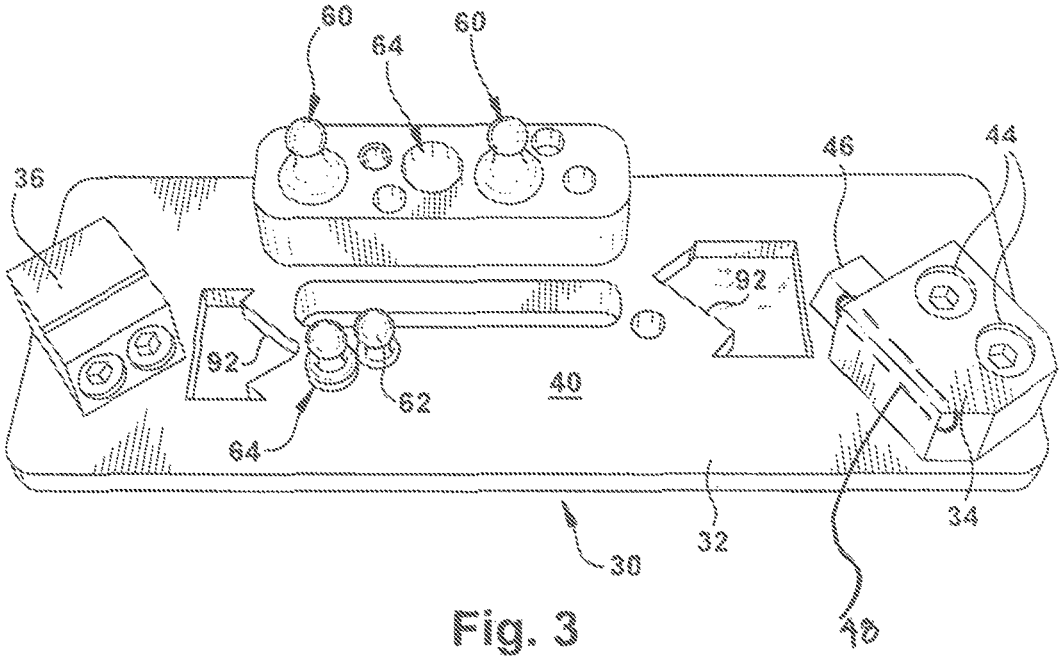
FIG. 3 is a bottom perspective view of the apparatus shown in FIG. 2.

FIG. 2 provides a top perspective view of an apparatus 30 for inspecting a turbine blade tip shroud 10 according to one embodiment of the present disclosure, and FIG. 3 provides a bottom perspective view of the apparatus 30 shown in FIG. 2. The apparatus 30 generally includes a frame 32 that is alignable with the turbine blade tip shroud 10. As used herein, "alignable" and (variants thereof) refers to a design that can be independently disposed on a plurality of turbine blade tip shrouds 10 by engaging with the standard or expected topographical profile of the turbine blade tip shroud 10 so that the relative of the position of the frame 32 with the turbine blade tip shroud 10 is consistent and repeatable when aligned thereon. The frame 32 may be made from wood, plastic, fiberglass, metal, or any other suitably durable materials capable of maintaining their shape. The frame 32 includes a top surface 38 and a bottom surface 40 and may further include one or more viewing holes 42 or other passages to allow visual observation of the tip shroud 10, and/or one or more aligning features such as a first stop 34, and/or a second stop 36 through the frame 32 as will become appreciated herein.

Figure 4:
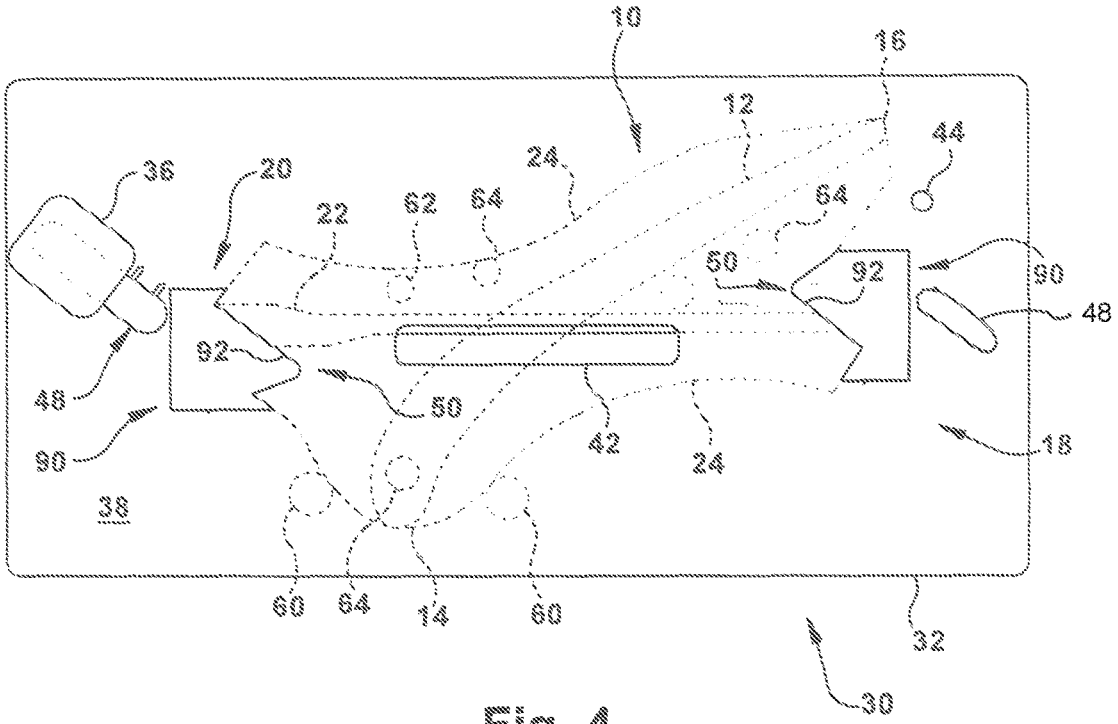
FIG. 4 is a top plan view of the apparatus shown in FIG. 2 positioned on the turbine blade tip shroud shown in FIG. 1.

The frame 32 further comprises at least one z-notch inspection slot 90 that passes through the frame 32 from the top surface 38 to the bottom surface 40. As best illustrated in FIG. 4, the at least one z-notch inspection slot 90 is positioned on the frame 32 to align with one of the z-notches 50 of the turbine blade tip shroud 10 when the frame 32 is aligned on the turbine blade tip shroud 10. Specifically, the z-notch inspection slot 90 comprises an interior edge 92 configured to the acceptable dimensional limits of the z-notch 50 itself. As should be appreciated herein, the interior edge 92 of the z-notch slot 90 may thereby align with the z-notch 50 of the turbine blade tip shroud 10 to provide a quick visual inspection guide for dimensional conformity, quality or the like. In some embodiments, such as that illustrated in FIGS. 2-5, the frame 32 may comprise first and second z-notch inspection slots 90 to individually align with first and second z-notches 50 respectively.

Figure 5:
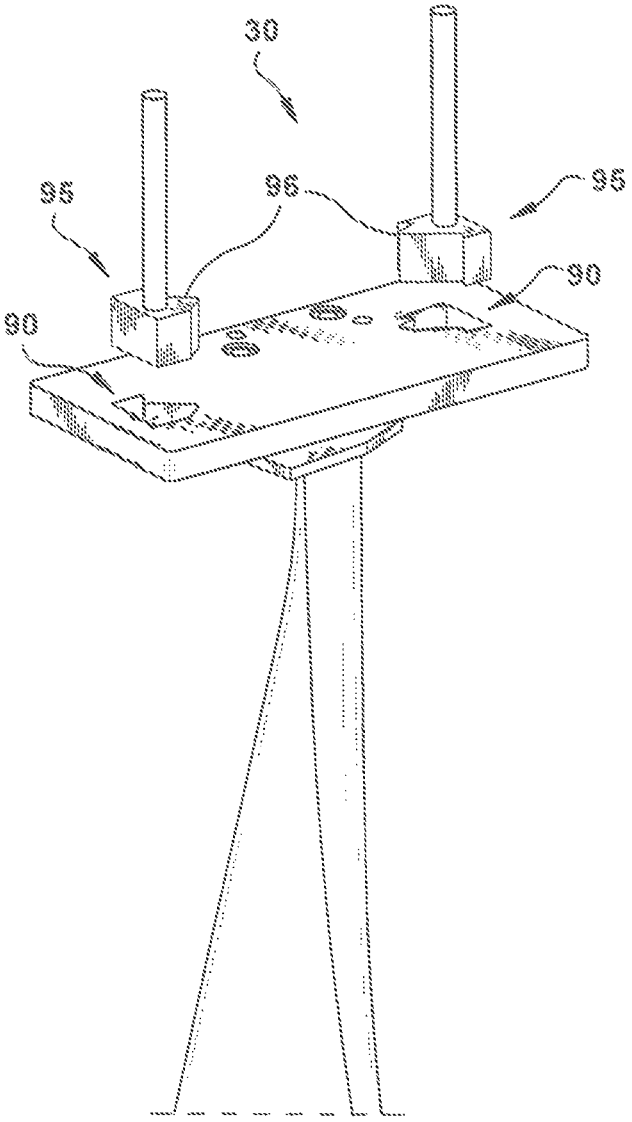
FIG. 5 is a perspective view of the apparatus shown in FIG. 2 positioned on the turbine blade tip shroud shown in FIG. 1.

Referring now to FIG. 5, the apparatus 30 further comprises a removable z-notch inspection insert 95 that comprises a cross-sectional profile substantially matching the at least one z-notch inspection slot 90. Specifically, the removable z-notch inspection insert comprises a z-notch guide face 96 that faces the z-notch 90 of the turbine blade tip shroud 10 (and the interior edge 92 of the z-notch inspection slot 90) when the removable z-notch inspection insert 95 is passed through the z-notch inspection slot 90. In use, the removable z-notch inspection insert 95 may be passed through the z-notch inspection slot 90 such that its z-notch guide face 96 passes by the interior edge 92 of the z-notch inspection slot and along the surface of the z-notch 50 itself. If the z-notch 50 has excessive material (such as from excessive weld build up, less than required finishing, or other modification operations), the removable z-notch inspection insert 95 will be blocked from passing through the z-notch inspection slot 90 by catching on the over built z-notch 50. This may lead to the tip shroud 10 being sent for additional work prior to (re)installation in a turbine. Conversely, in some embodiments, an under-dimensioned z-notch may be identified by leaving a gap between the z-notch 50 and the z-notch guide face 96 of the z-notch inspection insert 95 when passed through the z-notch inspection slot 90. Thus, the z-notch inspection slot 90 and the z-notch inspection insert 95 can thereby combine to provide a quick visual and/or physical quality control check on the dimensions of new or modified z-notches 90 of turbine bucket tip shrouds 10.

Referring back to FIGS. 2-3, first and potentially second stops 34, 36 may be positioned on the frame 32 to contact specific portions of the first and second side surfaces 18, 20, respectively to assist in aligning the frame 32 onto the turbine blade tip shroud 10. For example, a bolt 44, screw, or other device may be used to releasably attach the first stop 34 to a particular location on the frame 32 so that a first surface 46 of the first stop 34 is precisely aligned to contact a specific portion of the first side surface 18 of the tip shroud 10. In some embodiments, the first stop 34 and the first surface 46 may be repositioned and/or re-oriented on the frame 32 so that the same apparatus 30 may be used to inspect multiple tip shrouds having different geometries.

In some embodiments, a second stop 36 may similarly be releasably attached to a separate particular location on the frame 32 so that a surface of the second stop 36 is precisely aligned to contact a separate specific portion of the second side surface 20 of the tip shroud 10. However, in some embodiments, such as that illustrated in FIG. 3, the second stop 36 may be in sliding engagement with the frame 32 to contact a specific portion of the second side surface 20 of the turbine blade tip shroud 10. For example, as shown in FIGS. 3 and 4, the frame 32 may include a slot 48 (in phantom in FIG. 3) having a predetermined length and orientation with respect to the first stop 34. In particular embodiments, the slot 48 may be oriented perpendicular to or parallel to the first surface 46, depending on the particular orientation of the first surface 46 of the first stop 34. Alternately or in addition, the frame 32 may include an incremented scale adjacent to the slot 48 and/or second stop 36 to measure the amount of movement of the second stop 36 in the slot 48. In this manner, the second stop 36 may ride in the slot 48 until the second stop 36 either contacts the specific portion of the second side surface 20 or the second stop 36 reaches the end of the slot 48. If the second stop 36 contacts the specific portion of the second side surface 20 before reaching the end of the slot 48, then the tip shroud 10 may be refurbished, for example, by restoring a hardened material to the first and/or second side surfaces 18, 20. Alternately, if the second stop 36 reaches the end of the slot 48 before contacting the specific portion of the second side surface 20, then the tip shroud 10 may require modification before the apparatus 30 may be utilized to verify the dimensional acceptability of the z-notches 50.

As also illustrated in FIG. 3, the apparatus 30 may further additionally or alternatively comprise one or more other aligning features for aligning the frame 32 on the turbine blade tip shroud 10. In particular embodiments, the function of the one or more aligning features may be to longitudinally, transversely, and/or radially align the frame 32 with respect to the tip shroud 10. The structure for the means may include various combinations of resilient tabs and/or projections that extend from the bottom surface 40 of the frame 32. In the particular embodiment shown in FIG. 3, for example, the aligning features for the frame 32 with respect to the tip shroud 10 includes a plurality of resilient tabs 60 that extend away from the frame 32. The resilient tabs 60 may be positioned on the frame 32 so that when the frame 32 is placed on the tip shroud 10, the resilient tabs 60 act as bumpers or guides around the leading and/or trailing edges 14, 16 of the tip shroud 10 to position the frame 32 longitudinally and/or transversely with respect to the tip shroud 10. Alternately or in addition, the aligning features for the frame 32 with respect to the tip shroud 10 may include first projections 62 and/or second projections 64 on the bottom surface 40 of the frame 32. As shown in FIG. 3, the first projections 62 may be positioned on the frame 32 to rest against or contact the seal rail 22 to position the frame 32 longitudinally with respect to the tip shroud 10. Similarly, the second projections 64 may be positioned on the frame to act as spacers between the bottom surface 40 of the frame 32 and the tip shroud 10. In this manner, the second projections 64 may position the frame 32 radially with respect to the tip shroud 10.

Figure 6:
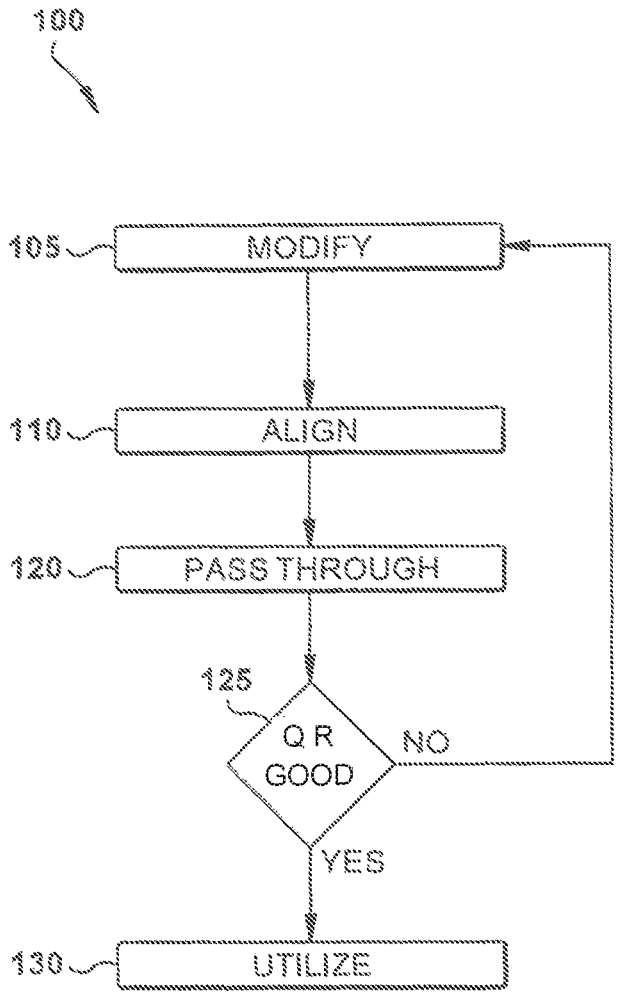
FIG. 6 is a flow diagram of a method for inspecting a turbine blade tip shroud.

Referring now additionally to FIG. 6, a method 100 is illustrated for inspecting a turbine blade tip shroud 10. The method at least first comprises aligning a frame 32 on the turbine blade tip shroud 10 in step 110. As discussed above, the frame comprises at least one z-notch inspection slot 90 that passes through the top surface 38 to the bottom surface 40 and is positioned to align with at least one z-notch 50 of the turbine blade tip shroud 10 while the frame 32 is aligned on the turbine blade tip shroud 10.

The method 100 at least further comprises passing a z-notch inspection insert 95 through the z-notch inspection slot 90 in step 120, wherein a z-notch guide face 96 of the z-notch inspection insert 95 will pass by the at least one z-notch 50 of the turbine blade tip shroud 10 if the z-notch 50 does not extend beyond the z-notch inspection slot 90.

In some embodiments, the method 100 may first comprise modifying the z-notch 50 of the turbine blade tip shroud 10 in step 105 prior to aligning the frame 32 with the turbine blade tip shroud 10 in step 110. Modifying may comprise any adjustment to the dimensional profile (e.g., size, shape, angle(s), etc.) of the z-notch 50 such as through weld build-up, blending and/or final contouring adjustments including from repair operations, restoration procedures or the like.

In even some embodiments, the method may comprise a quality control tollgate in step 125 following the attempting passing of the z-notch inspection insert 95 through the z-notch inspection slot 90 in step 120. For example, if the z-notch inspection insert 95 cannot pass through the z-notch inspection slot 90 (e.g., due to an overly sized modified or repaired z-notch 50), then the turbine blade tip shroud 10 may be sent back to step 105 for further modification and to repeat the overall method 100. Likewise, if the z-notch inspection insert 95 can pass through the z-notch inspection slot 90 (e.g., due to and indicating an appropriately sized z-notch 50), the turbine blade tip shroud 10 may be utilized for installation in a turbine in step 130.

One of ordinary skill in the art can readily appreciate that the apparatus 30 and methods described herein reduce the time required to consistently inspect z-notches 50 for a turbine blade tip shroud 10 to determine, for example, the dimensional acceptability of the part. As a result, the embodiments described herein may, in part, reliably identify only those tip shrouds 10 requiring modification, thus assisting in the quality control associated with the inspection and refurbishment of tip shrouds 10.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An apparatus for inspecting a turbine blade tip shroud, the apparatus comprising:

a frame comprising a top surface and a bottom surface that is alignable with the turbine blade tip shroud;

at least one z-notch inspection slot that passes through the frame from the top surface to the bottom surface and is positioned to align with at least one z-notch of the turbine blade tip shroud when the frame is aligned on the turbine blade tip shroud; and a removable z-notch inspection insert comprising a cross-sectional profile substantially matching the at least one z-notch inspection slot and comprising a z-notch guide face that faces the z-notch of the turbine blade tip shroud when the removable z-notch inspection insert is passed through the z-notch inspection slot, further comprising a first stop connected to the bottom surface of the frame to contact a first side surface of the turbine blade tip shroud.

2. The apparatus of claim 1, further comprising a second stop connected to the bottom surface of the frame to contact a second side surface of the turbine blade tip shroud.

3. The apparatus of claim 2, wherein the second stop is in sliding engagement with the frame to contact the second side surface.

4. An apparatus for inspecting a turbine blade tip shroud, the apparatus comprising:

a frame comprising a top surface and a bottom surface that is alignable with the turbine blade tip shroud;

a first z-notch inspection slot that passes through the frame from the top surface to the bottom surface and is positioned to align with a first z-notch of the turbine blade tip shroud when the frame is aligned on the turbine blade tip shroud;

a first removable z-notch inspection insert comprising a first cross-sectional profile substantially matching the first z-notch inspection slot and comprising a first z-notch guide face that faces the first z-notch of the turbine blade tip shroud when the first removable z-notch inspection insert is passed through the first z-notch inspection slot;

a second z-notch inspection slot that passes through the frame from the top surface to the bottom surface and is positioned to align with a second z-notch of the turbine blade tip shroud when the frame is aligned on the turbine blade tip shroud; and, a second removable z-notch inspection insert comprising a second cross-sectional profile substantially matching the second z-notch inspection slot and comprising a second z-notch guide face that faces the second z-notch of the turbine blade tip shroud when the second removable z-notch inspection insert is passed through the second z-notch inspection slot, further comprising a first stop connected to the bottom surface of the frame to contact a first side surface of the turbine blade tip shroud.

5. The apparatus of claim 4, further comprising a second stop connected to the bottom surface of the frame to contact a second side surface of the turbine blade tip shroud.

6. The apparatus of claim 5, wherein the second stop is in sliding engagement with the frame to contact the second side surface.

7. A method for inspecting a turbine blade tip shroud, the method comprising:

aligning a frame on the turbine blade tip shroud, wherein the frame comprises at least one z-notch inspection slot that passes through the top surface to the bottom surface and is positioned to align with at least one z-notch of the turbine blade tip shroud while the frame is aligned on the turbine blade tip shroud;

passing a removable z-notch inspection insert through the z-notch inspection slot, wherein a z-notch guide face of the z-notch inspection insert will pass by the at least one z-notch of the turbine blade tip shroud if the z-notch does not extend beyond the z-notch inspection slot, wherein the frame comprises a first stop connected to the bottom surface to contact a first side surface of the turbine blade tip shroud, and, a second stop connected to the bottom surface to contact a second side surface of the turbine blade tip shroud.

8. The method of claim 7, further comprising modifying the at least one z-notch prior to aligning the frame on the turbine blade tip shroud.

9. The method of claim 8, wherein modifying the at least one z-notch comprises adjusting a dimensional profile of the z-notch.

10. The method of claim 7, further comprising modifying the at least one z-notch if the removable z-notch inspection insert cannot pass through the at least one z-notch inspection slot.

11. The method of claim 7, further comprising utilizing the turbine blade tip shroud in a turbine if the removable z-notch inspection insert passes through the at least one z-notch inspection slot.

12. The method of claim 7, wherein aligning the frame on the turbine blade tip shroud comprises engaging the first stop with a first side surface of the turbine blade tip shroud, and, sliding the second stop with respect to the frame until the second stop contacts a second side surface of the turbine blade tip shroud.

13. The method of claim 7, wherein the turbine blade tip shroud comprises a used turbine blade tip shroud.

* * * * *